United States Patent [19]

Hubbell et al.

[11] Patent Number: 4,964,454

[45] Date of Patent: Oct. 23, 1990

[54] EVAPORABLE FOAM PATTERN FOR CASTING AN AIR INDUCTION MANIFOLD

[75] Inventors: James C. Hubbell, Fond du Lac; Gordon L. Stiller, Omro; David D. Liegeois, Oshkosh, all of Wis.

[73] Assignee: Brunswick Corporation, Skokie, Ill.

[21] Appl. No.: 281,187

[22] Filed: Dec. 7, 1988

[51] Int. Cl.[5] ..... B22C 7/02

[52] U.S. Cl. ..... 164/246; 164/34; 164/235

[58] Field of Search ..... 164/34, 35, 36, 45, 164/235, 246, 249; 123/52 M, 52 MC

[56] References Cited

U.S. PATENT DOCUMENTS

| | | | |
|---|---|---|---|
| 3,977,377 | 8/1976 | Reid | 123/52 M |
| 4,244,332 | 6/1981 | Kusche et al. | 123/52 M |
| 4,632,169 | 12/1986 | Osborn et al. | 164/45 |
| 4,640,333 | 2/1987 | Martin et al. | 164/45 |
| 4,657,063 | 4/1987 | Morris | 164/246 |
| 4,702,202 | 10/1987 | Hensel et al. | 123/52 MC |
| 4,777,997 | 10/1988 | Corbett | 164/246 |
| 4,802,447 | 2/1989 | Corbett | 164/235 |

*Primary Examiner*—Richard K. Seidel
*Attorney, Agent, or Firm*—Andrus, Sceales, Starke & Sawall

[57] ABSTRACT

An evaporable foam pattern for casting a metal air induction manifold for an internal combustion engine. The pattern is formed from an evaporable foam material, such as polystyrene, and in the assembled condition the pattern is in the form of an elongated body member having a generally rectangular cross section. One end of the body member is enclosed by an end wall while the opposite end of the body member is open. One of the side walls of the body member is provided with a plurality of generally parallel slots which are elongated in a lateral direction with respect to the longitudinal axis of the body member. The pattern is composed of a pair of longitudinal pattern sections each being generally U-shaped in cross section and having abutting edges disposed on a parting line. An adhesive joins the abutting edges. The parting line between the pattern section splits the opening in the end of the body member and all of the slots are formed in one pattern section.

8 Claims, 2 Drawing Sheets

EVAPORABLE FOAM PATTERN FOR CASTING AN AIR INDUCTION MANIFOLD

BACKGROUND OF THE INVENTION

Evaporable foam casting procedures have been used in casting metal engine blocks for internal combustion and other engine components. In a typical evaporable foam casting process, a pattern, which is identical in configuration to the metal part to be cast, is formed of an evaporable foam material, such as polystyrene. In the casting procedure, the pattern is placed in a mold and a flowable material, such as sand, is introduced into the mold around the pattern and also fills the cavities within the pattern.

A molten metal, such as an aluminum alloy, is introduced to the pattern via a sprue and the heat of the molten metal will vaporize the pattern with the vapor entering the interstices of the sand while the molten metal will fill the void created by vaporizaton of the pattern to provide a cast metal part which is identical in configuration to the foam pattern.

Evaporable foam casting has advantages over conventional sand casting procedures in that it is less costly, and more dimensionally accurate parts can be obtained. Moreover, certain complex configurations may be castable using evaporable foam techniques, while such parts cannot be cast using sand casting techniques.

SUMMARY OF THE INVENTION

The invention is directed to an evaporable foam pattern for use in casting a metal air induction manifold for an internal combustion engine and has particular use for casting the air induction manifold for a marine engine. The pattern is formed of an evaporable foam material, such a polystyrene, and in its assembled condition includes an elongated body member which is generally rectangular in cross section. One end of the body member is enclosed by an end wall while the opposite end of the body member is open which provides an air inlet in the cast metal manifold.

Formed in one of the side walls of the body member are a plurality of generally parallel slots which are elongated in a lateral direction with respect to the longitudinal axis of the body member. In the cast metal manifold, the slots serve as air outlets and a reed valve block is mounted in alignment in each slot.

In accordance with the invention, the pattern is formed of a pair of longitudinal pattern sections, each being generally U-shaped in cross section. The pattern sections have abutting edges disposed on a parting line and the abutting edges are joined by a layer of glue or adhesive of the type commonly used in evaporable foam casting processes.

The evaporable foam pattern of the invention enables the air induction manifold to be cast as a single integral member. The pattern sections are designed so that all of the outlet slots are in a single pattern section so that the slots are precisely located with respect to each other in the metal casting.

In an evaporable foam casting process, the pattern is initially coated with a ceramic wash and the pattern of the invention is designed so that the wash will contact all external and internal surfaces when the pattern is immersed in the wash bath and the wash will readily drain from the pattern. In addition, the pattern is designed such that, when introduced into the mold, sand will readily flow into and fill the internal cavity of the pattern.

Other objects and advantages will appear in the course of the following description.

DESCRIPTION OF THE DRAWINGS

The drawings illustrate the best mode presently contemplated of carrying out the invention.

In the drawings.

DESCRIPTION OF THE ILLUSTRATED EMBODIMENT

Figure 1:
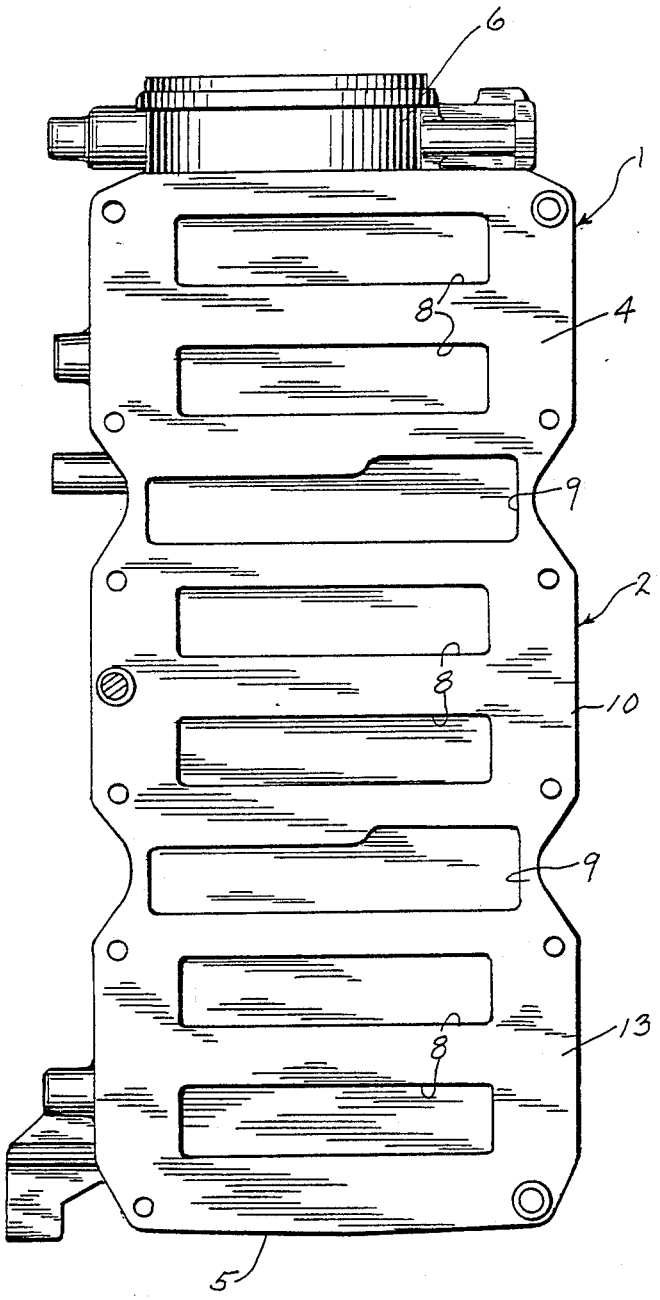
FIG. 1 is a side elevation of the pattern of the invention.
Figure 2:
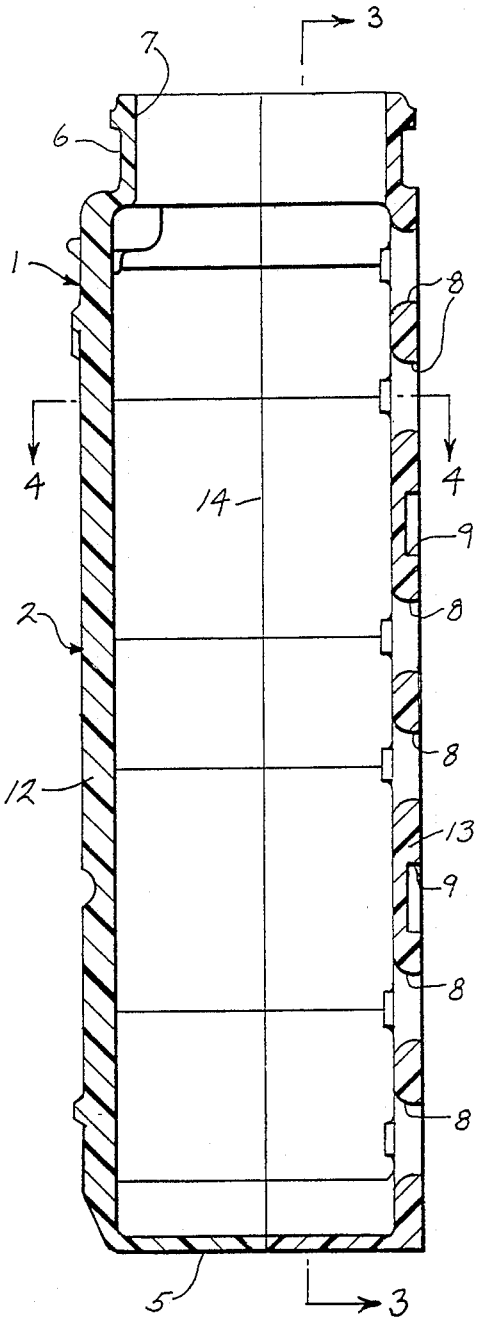
FIG. 2 is a longitudinal section taken along line 2—2 of FIG. 1.
Figure 3:
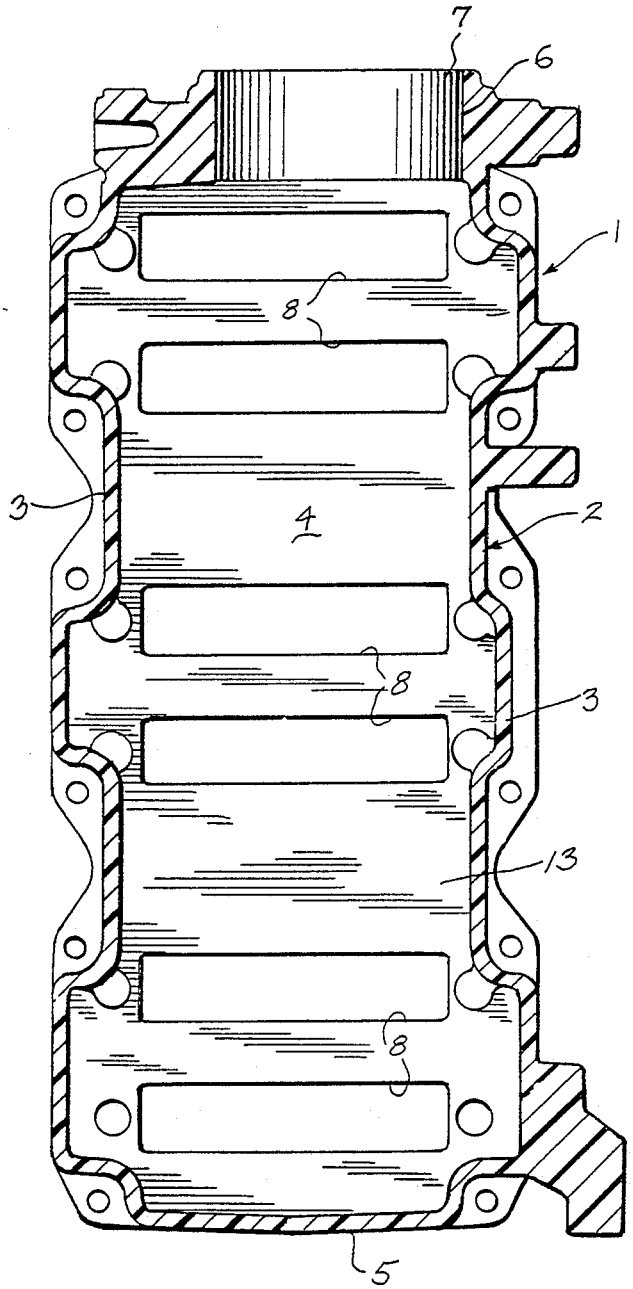
FIG. 3 is a longitudinal section taken along line 3—3 of FIG. 2.
Figure 4:
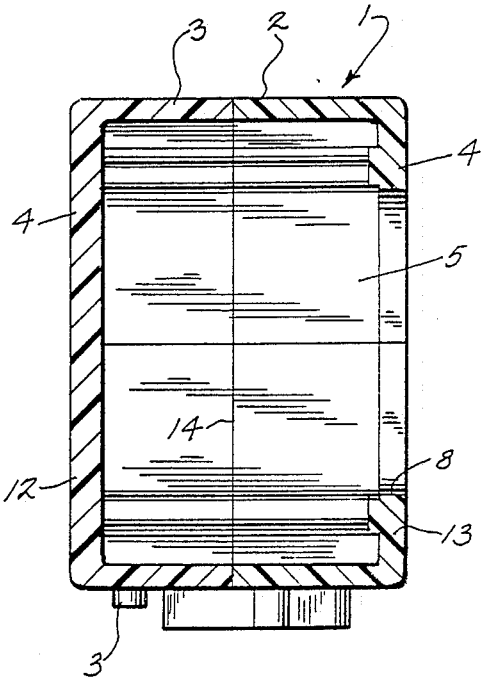
FIG. 4 is a transverse section taken along line 4—4 of FIG. 2.

The drawings illustrate a pattern 1 to be used in an evaporable foam casting process for casting a metal air induction manifold for an internal combustion engine and has particular application for casting the manifold of a V-6 outboard marine engine.

Pattern 1 is formed from an evaporable foam material such as polystyrene or polymethylmethacrylate, and is characterized by the ability to vaporize when heated through contact with the molten metal during the casting process.

The pattern 1 is identical in shape to the metal part to be cast and therefore, in the description reference will be made to the components of the cast metal manifold.

Pattern 1 includes an elongated hollow body 2 which is generally rectangular in cross section. Body 2 is formed of a pair of opposed walls 3 and opposed walls 4 which are joined together along their adjacent longitudinal edges to provide the rectangular configuration for body 2.

One end of body 2 is enclosed by end wall 5 which is connected to the ends of walls 3 and 4, while the opposite ends of body 2 is provided with a neck 6 which defines an opening 7. In the cast metal manifold, opening 7 constitutes an air inlet opening and a shutter valve is normally mounted within the opening 7.

One of the walls 4 is provided with a plurality of generally parallel elongated slots 8 and the slots 8 in the cast metal manifold constitute air outlets. A reed valve block is adapted to be mounted on the outside of wall 4 in registry with each slot 8. As previously noted, the manifold illustrated in the drawings is intended for use with one of the banks of cylinders of a V-6 outboard engine and two slots 8 are provided for each of the three cylinders in the bank.

Wall 4, which contains slots 8, also is provided with a pair of recesses 9 and in the metal casting the part number is normally cast in raised letters in at least one of the recesses.

Flange 10 extends laterally from the wall 4 that contains slots 8 and is provided with a plurality of holes 11 and in the cast metal manifold, bolts are adapted to be received within holes 11 to attach the manifold to the engine block.

In accordance with the invention, pattern 1 is formed of a pair of longitudinal pattern sections 12 and 13 each of which is generally U-shaped in cross section. The pattern sections 12 and 13 have abutting edges which are disposed along a parting line indicated by 14. A layer of glue or adhesive serves to join the abutting edges at the parting line 14.

The adhesive employed to join the pattern sections 12 and 13 is a type commonly used in evaporable foam casting procedures. During the casting process, the heat of the molten metal will vaporize the adhesive with the vapor being entrapped in the interstices of the sand so that there is no residual glue or adhesive in the cast metal part.

Parting line 14 splits the opening 7 and all of the slots 8 are formed in the pattern section 13 thereby insuring that the slots 8 will be precisely located in the cast metal manifold without the necessity of machining.

In fabrication of the pattern, the two pattern sections 12 and 13 are initially cast from the evaporable foam material, preferably in a die casting operation. The coating of the glue or adhsive is then applied to the abutting edges of the pattern sections and the pattern sections are placed in a suitable jig or fixture to maintain the sections in proper alignment until the adhesive has set.

The asssembled pattern is then coated with a ceramic wash material of the type conventially used in an evaporable foam casting process. The pattern is normally coated by immersing the pattern in bath of the wash. The pattern is desiged so that upon immersion, the wash will contact all the internal and external surfaces of the pattern and excess wash will readily drain from the pattern.

The pattern is then placed in a mold and a flowable material, such as sand, is introduced into the mold around the pattern. The sand will also flow into the internal cavity of the pattern.

The pattern is connected by an evaporable foam sprue to a pouring funnel and when the molten metal is introduced into the funnel, the heat of the molten metal will vaporize the pattern with the vapor being entrapped within the interstices of the sand while the molten metal will fill the void created by vaporization of the pattern to produce a cast metal part that is identical in configuration to the evaporable foam pattern.

Through use of the pattern of the invention the air induction manifold can be cast as an integral one piece part.

Various modes of carrying out the invention are contemplated as being within the scope of the following claims particularly pointing out and distinctly claiming the subject matter which is regarded as the invention.

We claim:

1. An evaporable foam pattern for casting a metal air induction manifold for an internal combustion engine, the assembled pattern comprising an elongated hollow body member formed of an evaporable foam material, said body member including a side wall and having an end wall enclosing one end of said side wall, the opposite end of said body member having an opening, said side wall including a plurality of slots extending therethrough, said pattern being composed of two longitudinal sections having abutting edges disposed along a longitudinal parting line, said parting line extending through said end wall and through said opposite open end, all of said slots being disposed in one of said pattern sections, and means for joining said abutting edges.

2. The pattern of claim 1, wherein said side wall is generally rectangular in cross section and includes a pair of opposed first walls and a pair of opposed second walls, the adjacent side edges of said first and second walls being connected together to provide said rectangular cross section, said parting line disposed in said first walls and said slots being disposed in one of said second walls.

3. The pattern of claim 1, wherein said slots are elongated in a direction lateral of the longitudinal axis of said body pattern and said slots are disposed in spaced generally parallel relation.

4. An evaporable foam pattern for casting a metal air induction manifold for an internal combustion engine, the assembled pattern comprises an elongated hollow body member having a generally rectangular cross section and composed of a pair of opposed first walls and a pair of opposed second walls connected along adjacent side edges to provide said rectangular cross section, an end wall enclosing a first end of said body member, a second end of said body member being open, one of said second walls being formed with a plurality of generally parallel elongated slots, said slots being elongated in a direction lateral of the longitudinal axis of said pattern, said pattern being composed of two longitudinal sections each having a generally U-shape cross section, said pattern sections having abutting edges disposed along a longitudinal planar parting line, said parting line being disposed in said first walls and extending through said open end, all of said slots being disposed in one of said second walls, and adhesive means for joining said abutting edges.

5. The pattern of claim 4, wherein said second end has a reduced cross sectional area as compared to the remainder of said body member.

6. The pattern of claim 4, wherein said parting line is disposed centrally of said second end.

7. The pattern of claim 4, wherein said second wall is provided with six slots.

8. The pattern of claim 7, wherein said slots are generally rectangular in configuration.

* * * * *